US005291849A

United States Patent [19]

Zeitler

[11] Patent Number: 5,291,849

[45] Date of Patent: Mar. 8, 1994

[54] FLAG SUPPORT WITH FURL PREVENTER

[76] Inventor: Richard J. Zeitler, 36 High Ridge Rd., Brookfield, Conn. 06804

[21] Appl. No.: 988,711

[22] Filed: Dec. 10, 1992

[51] Int. Cl.[5] ..... G09F 17/00

[52] U.S. Cl. ..... 116/174; 116/173

[58] Field of Search ..... 116/173, 174

[56] References Cited

U.S. PATENT DOCUMENTS

| | | | |
|---|---|---|---|
| 1,253,380 | 1/1918 | Hoffman | 116/174 |
| 1,277,347 | 9/1918 | Allen | 116/174 |
| 3,820,500 | 6/1974 | Merryweather | 116/174 |

*Primary Examiner*—Daniel M. Yasich

*Attorney, Agent, or Firm*—Bruce E. Hosmer; Howard S. Reiter

[57] ABSTRACT

A support assembly for displaying a banner on a flagstaff includes a base support for holding the base edge of a banner in extended condition, and an adjustable length deflector element extending from a point between the ends of the support element. The free end of the deflector element is attachable to the fabric of the flag at a central point within the flag's outer peripheral borders. The defector element is formed of resilient material and it is coupled to the support element by a guide bracket that includes a guide channel for bending the deflector element through a right angle. Dimensions of the guide channel and the deflector element are selected so that the deflector is free to slide telescopically within the channel to vary the length of the portion of the deflector extending from the support element. At the opposite end of the deflector, a right-angle projection engages a hole formed in the support element to retain the deflector in a desired extended position. By adjusting the distance between the free end of the deflector and the base edge of the flag, the support assembly may be adjusted specifically to various sizes of flags and various support angles between horizontal and vertical.

11 Claims, 3 Drawing Sheets

FLAG SUPPORT WITH FURL PREVENTER

BACKGROUND OF THE INVENTION

This invention relates generally to display supports for flags, banners and the like, and more specifically relates to a support assembly for preventing banners from wrapping around an associated supporting mast that is mounted in a non-vertical orientation.

Flags, pennants and banners, which for convenience will be referred to herein collectively, as banners, are frequently "flown" or displayed by attachment to vertical masts or flag poles. However, banners are also commonly displayed at the ends of masts and poles that are mounted at an angle part way between vertical and horizontal, because the surface patterns are more fully and clearly visible when a banner is suspended in that position. For further convenience in this specification, masts, poles and all other forms of elongate supports for banners and the like, will be referred to collectively, as staffs.

Although banners are known to be displayed more fully and effectively on staffs that are tilted from vertical toward horizontal, display of banners on such staffs is subject to a significant drawback that does not affect display on fully vertical staffs. Specifically, banners displayed in the outdoors are subject to widely variable natural wind forces that frequently result in the banner becoming wrapped or furled around the supporting staff.

In the of fully vertical support staffs, the forces of gravity naturally and inevitably cause a banner to "unwind" from around the staff when wind forces abate. On the other hand, in the case of staffs positioned at an angle between vertical and horizontal, natural "waving" or "flapping" of the attached banner often causes it to wrap around the semi-horizontal staff in response to wind forces, and to remain in that position, substantially furled, undisplayed and unattractive, when wind forces abate. When banners have become furled or wrapped around semi-horizontal staffs, they tend to remain in that position indefinitely due to the force of gravity, until they are manually unwrapped and restored to their "normal" unfurled display condition.

In the unfurled condition, banners hang freely, suspended from a single base edge attached to the staff. In the most commonly used display mounting arrangement, the base edge of the banner is engaged at its opposite ends and secured at those two points to the mounting staff, so that the base edge is extended to substantially its full length along and parallel to the axis of the staff. When the staff is tilted at an angle from the vertical, the base edge of the banner is extended effectively in the horizontal direction, so that the base edge becomes more and more nearly horizontal as the angle of tilt away from the vertical is increased. It is evident to even the most ordinary observation, that a banner is most fully extended for display purposes when the base edge is extended to its full length in the fully horizontal position. However, it is also evident that the "draping" effect that causes fabric to "roll" and creates the appearance of "fullness" when the base edge of a banner is extended at an angle between vertical and horizontal, adds substantially to the pleasing effect of the display and heightens the overall aesthetic appearance. It is highly desirable that any device intended to prevent a banner from becoming furled around a supporting staff, should also allow the banner to hang in a natural draped arrangement when it is at rest. Further, any such device should, preferably, allow the banner to "wave" as naturally as possible in reaction to ordinary wind forces.

In the prior art, various devices have been proposed for the prevention of wind-induced "furling" of banners around supporting staffs. These prior art devices have generally taken the form of rigid elongate bracing rods, positioned to extend along either the top or bottom edge of a banner generally at a right angle to the flag pole or staff. Displaying a banner in this way results in the upper or lower edge of the banner being held in an unnatural and unattractive position relative to the staff, preventing the pleasing effect achieved by natural "draping" when the banner is at rest. In others, the rod is merely attached fixedly along all, or a portion of, the upper or lower edge, without regard to fixing the relation of the rod to the staff and/or to the base edge of the banner; these devices are known to be subject to many of the same problems of wrapping, i.e. furling, or "fouling" the banner about the staff that affect banners mounted with no anti-fouling aids at all, and they are regarded as being minimally effective for their intended purpose. It can also be seen that a rigid support attached along an edge of the banner prevents that edge in particular from waving or rippling in any manner and further detracts from the desired pleasing aesthetic appearance of the display.

Accordingly, it is an object of this invention to provide an anti-furling support and display assembly for banners that permits the banner to drape in a natural and aesthetically pleasing manner when it is hanging at rest, supported on a staff positioned at an angle between horizontal and vertical.

It is another object of this invention to provide an anti-furling display support assembly that is readily and conveniently adjustable to accommodate a wide range of banner sizes and staff mounting angles.

It is still another object of this invention to provide an anti-furling display support assembly that can be attached to an associated banner conveniently and inconspicuously at a desirable and proper location without altering or damaging the fabric of the banner.

Yet another object of this invention is to provide a display assembly of the type described, which permits a banner to extend from the "at rest" position to a wind-induced "waving" position, while causing minimum interference with the natural flow of the fabric.

And, yet another and further object of this invention is to provide a device of the type described which is simple and inexpensive to manufacture and which can be installed easily without special knowledge or equipment.

These and other and further objects, features and advantages of this invention will be made more apparent by reference to the following specification and the accompanying drawings, in which:

DETAILED DESCRIPTION

Figure 1:
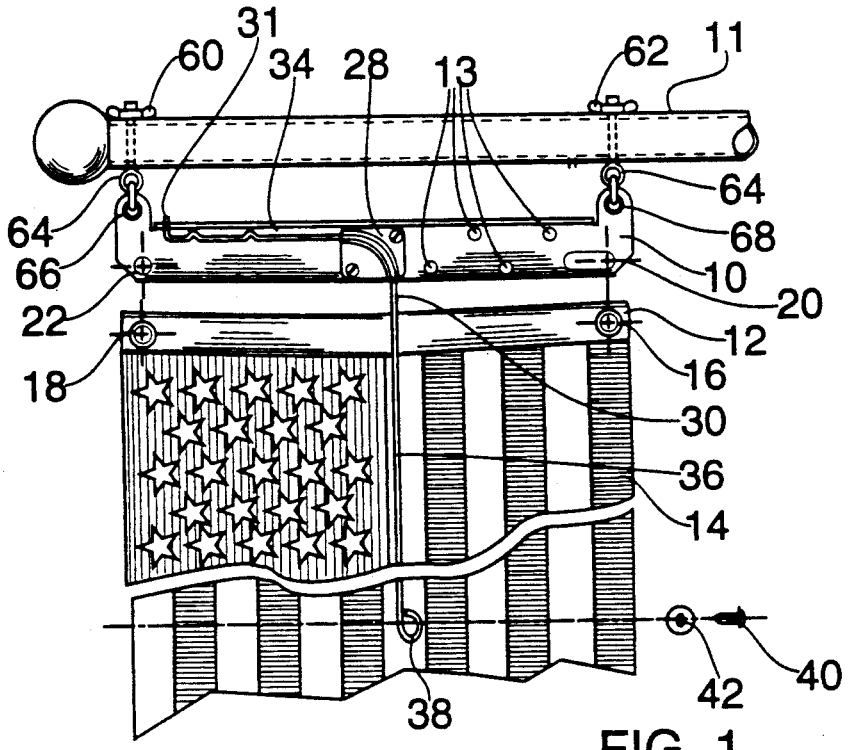
FIG. 1 is a partial pictorial representation of a flag support assembly in accordance with this invention, shown supporting a flag on a staff.
Figure 2:
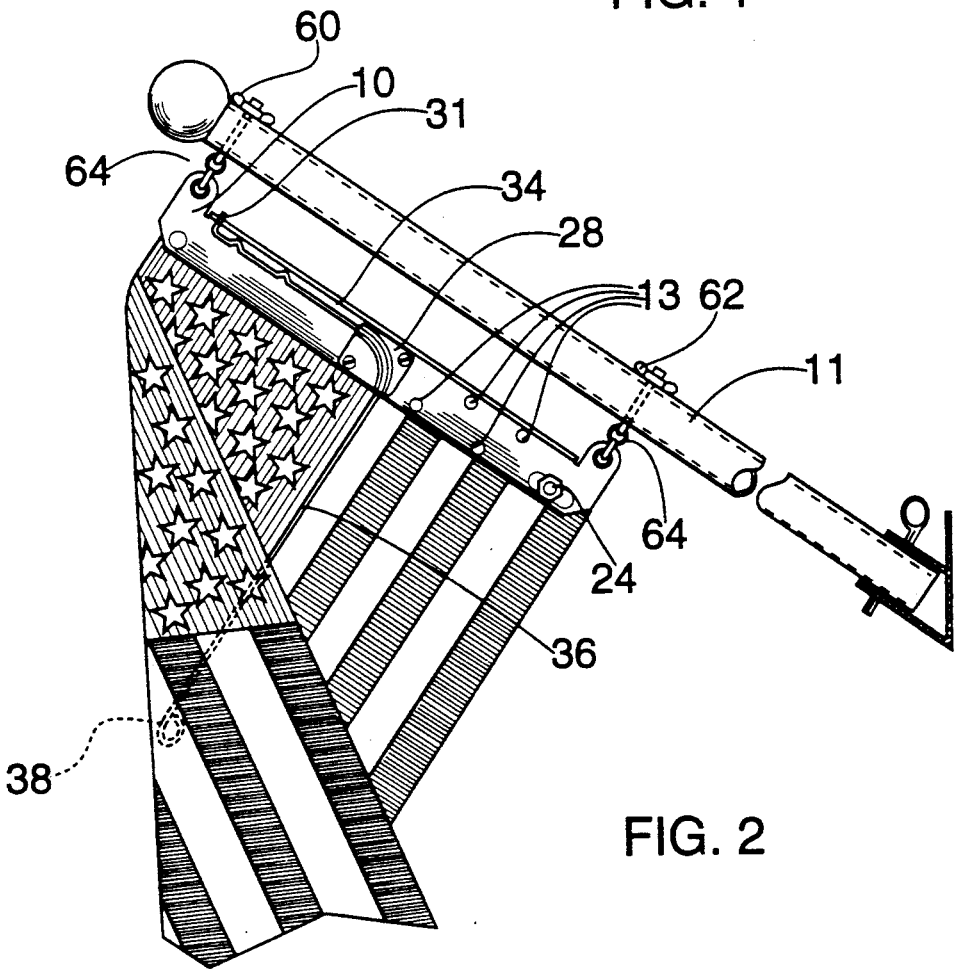
FIG. 2 illustrates the flag support assembly of FIG. 1 in another position, with the flag draped in a natural manner.
Figure 3:
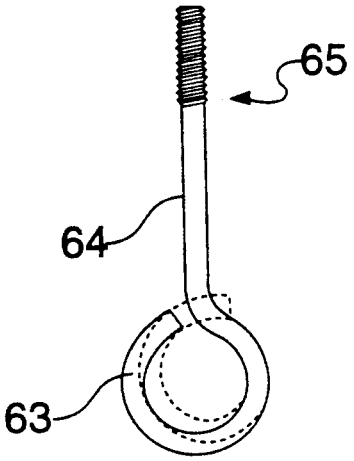
FIG. 3 shows an eyebolt of the type used to mount the flag support assembly of FIG. 1 to a flag staff.
Figure 6:
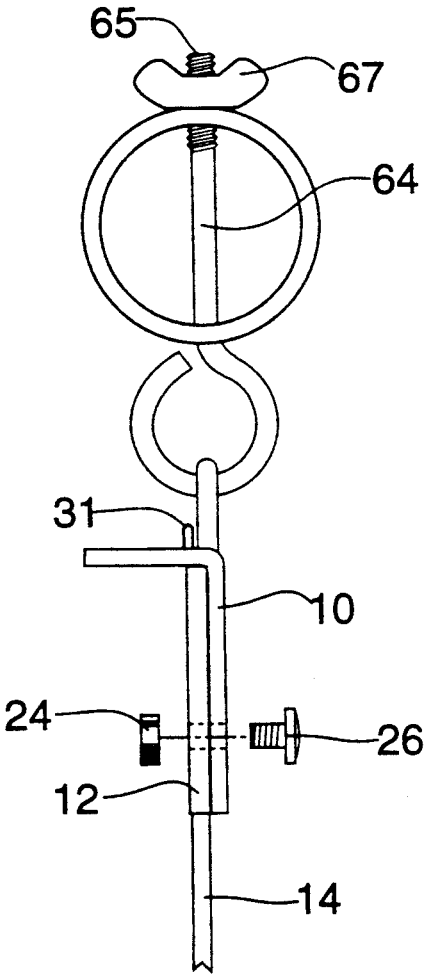
FIG. 6 is a partial cross-sectional view taken along line A—A of FIG. 1, showing how the flag support assembly is coupled to a flag staff.

Referring now more specifically to the drawings, the flag support assembly of FIGS. 1 and 2 may be seen to comprise an elongate support member 10 coupled to the base edge 12 of a banner 14 at spaced-apart locations 16 and 8. It should be understood in this regard that banner 14 is shown for the purpose of illustration only, and it should not be regarded as an inherent part of the invention, per se. Coupling means, in the form of slots or hole openings such as 20 and 22 at spaced-apart locations 16 and 18 are provided for attaching a banner such as 14 to the support member 10 using any conventional retention device. Suitable retention devices may include a nut 24 and bolt 26 as shown in FIG. 6, extending through openings 20, 22 and the corresponding customary openings in the edge of a flag.

The intended function of coupling means 20, 22 and 24, 26 is to assure that the base edge 12 of a banner 14 will be supported in substantially fully extended condition by elongate support member 10, independently of a flag staff.

Figure 4:
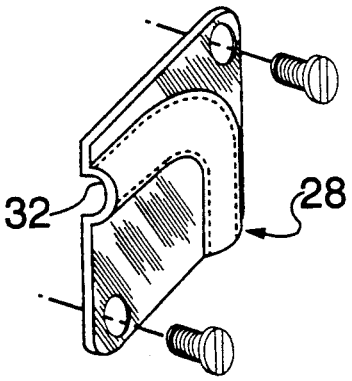
FIG. 4 is a pictorial view of the guide element that forms part of the flag support assembly in accordance with this invention.
Figure 5:
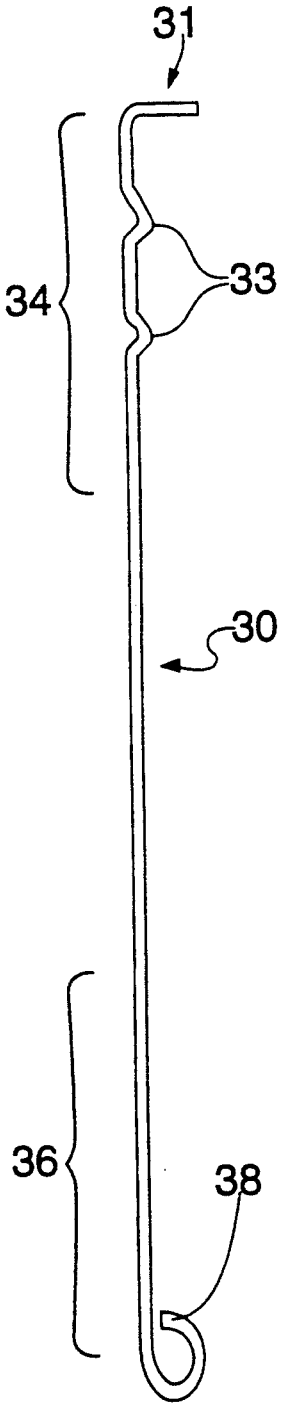
FIG. 5 is a detail of the deflector element that forms part of the support assembly of FIG. 1.

A guide bracket 28 mounted on elongate support member 10 engages and couples an adjustable deflector element 30 to the support member 10. The guide bracket 28 includes a formed guide channel 32 as shown in FIG. 4, shaped and dimensioned to receive a deflector element 30 in the form of a stiffly flexible wire member such as may be formed from piano wire or the like of suitable diameter and flexibility. Deflector element 30 normally assumes a substantially straight-line configuration between its two ends as shown in FIG. 5, except when it is resiliently bent into another configuration as shown in FIGS. 1 and 2. The purpose of guide bracket 28 is to resiliently bend a portion of deflector element 30 into a substantially right angle shape, so that the first end portion 34 lies substantially parallel to support element 10 while the opposite end portion 36 extends at a substantially right angle to the support element 10. When deflector element 30 is supported in this position, its free end 38 lies in the central area of a banner 14, spaced away from all four edges. With proper selection of the physical characteristics of deflector element 30, and with appropriate dimensions, element 30 fits slidably within channel 32 in guide bracket 28. By sliding element 30 relative to bracket 28, the relative lengths of the first end portion 34 and opposite end portion 36 can be changed at will to vary the distance between free end 38 and support member 10. An important advantage of being able to adjust the perpendicular distance between free end 38 and support member 10 results from basic geometrical relationships; as seen most clearly in FIG. 2, the free end 38 can be positioned readily relative to the support member 10 and the flag staff 11, for any angular position of the staff between vertical and horizontal, so that the fabric will be free to "fall" naturally in a vertical line from the uppermost support point on support member 10.

For most angular positions of a support staff 11, deflector element 30 may extend conveniently from a point midway between the ends of support member 10. However, for increased adjustability, and particularly for applications in which the support 10 is positioned more nearly vertically, the effective length of the deflector between free end 38 and support member 10 can be increased by arranging for the free end to extend from a position on the support 10 that is closer to its lowest point. Provision is made for this arrangement by incorporating a plurality of sets of mounting holes 13 in support member 10 for cooperation with corresponding holes in guide bracket 28, so that the bracket may be moved to a plurality of positions along the length of support 10, depending upon the angular position in which the support is positioned. Holes 13 in support 10 may be internally threaded to receive screws inserted through bracket 28, or nuts and bolts may be used with non-threaded holes in the obvious manner.

FIG. 5 illustrates first end 34 of deflector element 30 is formed with a retention projection 31 extending at an angle to the longitudinal axis of element 30; projection 31 cooperates with any one of a plurality of spaced-apart holes or recesses 29 formed in support member 10, as shown in FIGS. 1 and 2, to retain the deflector element 30 releasably in any one of a plurality of selected positions relative to the support element 10. Accordingly, when deflector element 30 has been positioned relative to the support member 10 by sliding movement within channel 32 of bracket 28, projection 31 may be positioned within the nearest one of holes 29 by slight further sliding movement, if necessary. The resilient spring-like action of deflector 30 will act to bias projection 31 into the hole 29 in a manner that can be understood easily. Added resilience to enhance this retention action, can be obtained if desired, by providing the body of deflector 30 with one or more "knee" bends 33 in the portion of the deflector 30 near to projection 31. Knee bends 33 additionally serve as a convenient means for gripping deflector 30 to disengage projection 31 from holes 29; for this purpose, the knee bends 33 are shaped so that they project above the abutting surface of support 10 when projection 31 is engaged in one of the holes 29. It can be seen that the retention action of projection 31 will serve to substantially "fix" the position of deflector 30 relative to support 10 in a manner that will prevent inadvertent displacement of the two under most ordinary circumstances, but will permit rapid and convenient release and relocation.

The free end 38 of deflector element 30 may be shaped into any suitable configuration such as a loop as shown in FIGS. 1 and 2, for receiving any conventional fastener, such as a "stud pin" 40 and clip 42 to secure the free end 38 to the fabric of a banner 14 at a chosen position within the four outer edges. In this context, a stud pin and clip may be of the type commonly used to removable attach lapel pins and the like to clothing, or to attach tie "tacks" to neckties and similar items of apparel.

Figure 7:
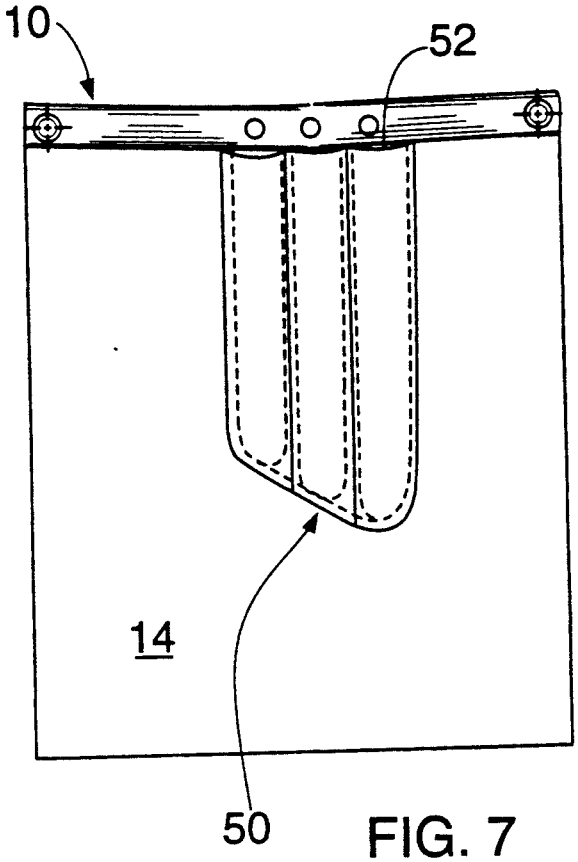
FIG. 7 is a plan view of a flag modified for use in accordance with another embodiment of this invention.

Although stud pins and clips have been described as suitable for attaching free end 38 to a central point on a flag 14, it should be apparent that any suitable detachable or semi-detachable attachment means may be used for fastening the free end 38 to the flag. For example, as shown in FIG. 7, any flag may be provided with one or more added pockets 50 securely attached to the fabric of the flag for slidably receiving the free end 38 of deflector 30 through an open end 52 of the pocket facing the base edge 12 of the flag as shown in FIG. 7. The length of a suitable pocket 50, from its closed end to its open end need only be sufficient to receive the free end 38 so that it cannot be withdrawn inadvertently while deflector 30 remains in its position relative to support member 10, and the flag remains coupled to the support member. For this purpose, the free end 38 of deflector 30 may be smoothly shaped in any desired manner to facilitate insertion and withdrawal.

In actual use, support member 10 is coupled to a flag staff 11, as shown most clearly in FIG. 1, at the spaced apart points 60 and 62. At each location, an eye-bolt 64 is securely attached to the staff, for example by drilling a hole through the staff and inserting the threaded portion 65 of the bolt through the hole. Each of a pair of openings 66 and 68 in support member 10 is looped over the opening in a separate one of the eyebolts to form a pivotal coupling between the staff 11 and support 10. To assure retention of the support 10 in the eyebolts 64, the "eye" portion 63 of each bolt may be malleably bent open to receive the openings in support 10 and then bent closed again, in a manner well-known for such devices; a wing nut 67, of conventional design serves conveniently to secure the bolts 64 to the staff 11. The nature of the illustrated coupling is such that the support 10 is constrained so that it cannot rotate significantly more than 180 degrees in either direction about staff 11, from its at-rest position, and eyebolt 64 is fixed against any rotation relative to a flagstaff. However, it should be understood that alternative arrangements are possible within the scope of this invention; for example, a rotary mounting of any well-known type such as a slip ring or a rotary ball-bearing assembly might be substituted for eyebolt 64, so that support member 10 would be free to rotate 360 degrees or more in either direction about the longitudinal axis of an associated flagstaff while continuing to prevent furling of a banner about the staff, in accordance with this invention.

Accordingly, it can be seen that, when free end 38 of deflector 30 is attached to a flag 14 at a point between the base 12 and the opposite edge, a banner attached to support member 10 cannot furl around an attached staff 11, unless the length of the flag between base edge 12 and the engagement point of free end 38 of deflector 30, is significantly less than the length between the free end 38 and the opposite edge (not shown) of the flag 14.

Figure 8:
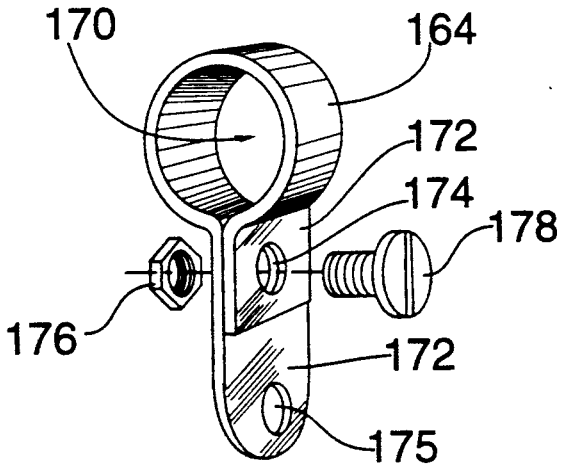
FIG. 8 is an isometric view of another form of mounting bracket for attaching a flag support to a flag staff in accordance with this invention.
Figure 9:
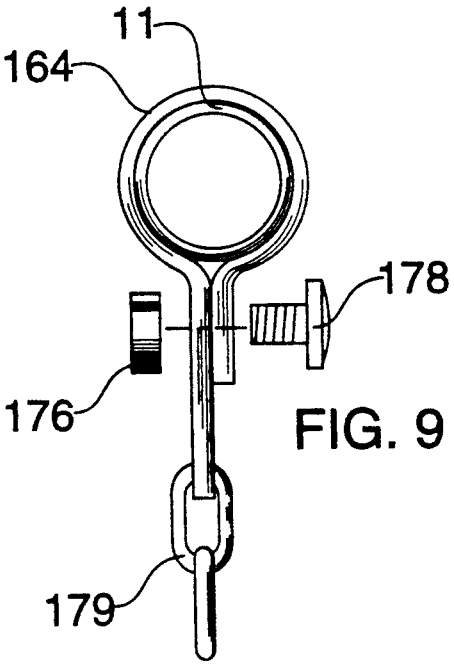
FIG. 9 is a side elevation view of the mounting bracket of FIG. 8, showing a pivot link element coupled thereto.

An alternative form of coupling for securing the support 10 to a staff 11 is illustrated in FIGS. 8 and 9. The device, identified generally by reference numeral 164, has the well-known form of a tubing clamp, with a looped opening 170 having radially extending strap portions 172 with aligned openings 174 for receiving a nut 176 and bolt 178 to draw the ends of the loop 170 together to tighten the clamp and fix it in position relative to an encircled pipe or tubular structure such as staff 11. A further extension of one end of the loop contains an additional opening 175 for engaging either a support member 10 directly, as previously described with reference to the embodiment of FIG. 6, or for engaging a coupling link 179 as shown in FIG. 9 which will, in turn, be coupled to a support 10, as described herein.

Although a preferred embodiment of this invention now has been described in detail, it will be evident to those having skill in this art that other and different versions and embodiments may be designed and developed without departing from the spirit and scope of the invention set forth in the following claims.

What is claimed is:

1. An adjustable furl-preventing banner support assembly, comprising:

an elongate support member for alignment parallel to a base of a banner;

a first coupling means at one end of said support member for engaging the base of a banner at a first location;

a second coupling means at the opposite end of said support member for engaging the base of a banner at a second location spaced from said first location;

said first and second coupling means being spaced apart on said elongate support member so as to maintain the base of a banner in substantially fully extended manner between said first and second locations when the base is engaged by said first and second coupling means;

an elongate deflector element of stiffly flexible material detachably mounted to said support member in substantially fixed position intermediate the ends thereof and extending at an angle thereto, to position a free end thereof remote from said support member at a point within the outer borders of a banner attached to said support member;

the free end of said deflector element having means for attachment to a center portion of fabric of a banner attached to said support member; and mounting means pivotably coupled to said support member at spaced apart locations proximate the opposite ends thereof, for attaching said support member to an elongate flag staff and limiting rotation of said support member bout the axis of said mounting means to not substantially more than 180 degrees in either direction from a central position.

2. An adjustable furl-preventing banner support assembly in accordance with claim 1, wherein the length of said deflector element between the free end thereof and said support member is adjustable.

3. An adjustable furl-preventing banner support assembly in accordance with claim 1, wherein said deflector element is positionable on said support member for insertion into a pocket attached to the fabric of a banner within the rectangular borders thereof.

4. An adjustable furl-preventing banner support assembly in accordance with claim 3, wherein the free end of said deflector element is shaped to facilitate insertion into and withdrawal from a pocket formed on the surface of a banner.

5. An adjustable furl-preventing banner support assembly, comprising:

an elongate support member for alignment parallel to a base of a banner;

a first coupling means at one end of said support member for engaging the base of a banner at a first location;

a second coupling means at the opposite end of said support member for engaging the base of a banner at a second location spaced from said first location;

said first and second coupling means being spaced apart on said elongate support member so as to maintain the base of a banner in substantially stretched out manner between said first and second locations when the base is engaged by said first and second coupling means;

a deflector guide bracket for a deflector element, mounted on said support member between the ends thereof;

said deflector guide bracket having an elongate channel therein characterized by a first channel end and a second channel end, for receiving an elongate deflector element in axially slidable relationship therewith;

said channel in said deflector guide bracket having an angular bend between the said firs channel end and the said second channel end so that a portion of said channel at one channel end is positioned in non-parallel relationship with the portion of said channel at the other channel end;

an elongate flexible deflector element of spring material slidably engaged in said channel;

said deflector element having an overall axial length greater than the overall length of said channel between said first channel end and said second channel end, so that a first end of said deflector element may extend from one channel end of said channel and a second end of the deflector element may extend from the other channel end when said deflector element is slidably engaged in said channel;

said deflector bracket being mounted to said support member with the portion of the channel at one channel end substantially parallel to said support member, so that as the first end of the deflector element is advanced axially into the deflector guide bracket, the second end of the deflector extends in non parallel relationship to the length of said support member, and the perpendicular distance from the axis of said support member to the said second end of said deflector increases correspondingly; and mounting means pivotably coupled to said support member at spaced apart locations proximate the opposite ends thereof, for attaching said support member to an elongate flag staff.

6. An adjustable furl-preventing banner support assembly in accordance with claim 5, wherein said deflector element includes means at the second end thereof for attachment to the fabric of a banner intermediate the edges thereof.

7. An adjustable furl-preventing banner support assembly in accordance with claim 6, wherein said means for attachment to the fabric of a banner comprises a needle element for penetrating through the fabric and a clamp element for gripping the needle element after it has penetrated the fabric to prevent withdrawal of the needle element through the fabric.

8. An adjustable furl-preventing banner support assembly in accordance with claim 5, wherein said deflector bracket is movable to various locations along the length of said support member.

9. An adjustable furl-preventing banner support assembly in accordance with claim 5, wherein said deflector element is formed of stiffly flexible wire.

10. An adjustable furl-preventing banner support assembly in accordance with claim 5, wherein said mounting means includes a tubing clamp element for encircling and gripping a flag staff.

11. An adjustable furl-preventing banner support assembly in accordance with claim 5, wherein said mounting means includes a threaded eyebolt dimensioned for insertion through a hole in a flagstaff, and the threaded portion of said eyebolt is dimensioned to receive a nut for clamping said bolt to a flagstaff.

* * * * *